United States Patent [19]

Koehl et al.

[11] Patent Number: 4,740,102

[45] Date of Patent: Apr. 26, 1988

[54] APPARATUS FOR POSITIONING ROAD CURBS, AUTOBLOCKING PAVING BLOCKS AND THE LIKE

[76] Inventors: Jean-Marie G. R. Koehl; Alain J. Koehl; Francois A. Koehl, all of 3 rue Varengue, 92340 Bourg la Reine, France

[21] Appl. No.: 822,269

[22] Filed: Jan. 24, 1986

[30] Foreign Application Priority Data

Jan. 25, 1985 [FR] France ..... 85 01035
Jun. 21, 1985 [FR] France ..... 85 09459

[51] Int. Cl.[4] ..... E01C 19/52
[52] U.S. Cl. ..... 404/99; 404/73
[58] Field of Search ..... 404/73, 99, 116; 414/724, 744 A; 280/774, 771

[56] References Cited

U.S. PATENT DOCUMENTS

| | | | |
|---|---|---|---|
| 637,644 | 11/1899 | McAlpine | 280/771 X |
| 2,580,045 | 12/1951 | Reed | 403/93 X |
| 2,581,568 | 1/1952 | Wooley | 414/744 A X |
| 2,934,035 | 4/1960 | Hardy | 280/771 X |
| 3,312,361 | 4/1967 | Foster | 414/724 |
| 3,741,083 | 6/1973 | Freidenberg et al. | 404/116 |
| 4,168,130 | 9/1979 | Barth et al. | 404/99 |
| 4,405,282 | 9/1983 | Carter | 414/724 |
| 4,428,710 | 1/1984 | Grisebach et al. | 414/744 A X |

FOREIGN PATENT DOCUMENTS

| | | | |
|---|---|---|---|
| 34999 | 9/1981 | European Pat. Off. . | |
| 2426713 | 12/1975 | Fed. Rep. of Germany | 404/99 |
| 2715476 | 10/1978 | Fed. Rep. of Germany | 404/99 |
| 2756440 | 6/1979 | Fed. Rep. of Germany | 404/99 |
| 3343991 | 6/1985 | Fed. Rep. of Germany | 404/99 |
| 3446231 | 7/1985 | Fed. Rep. of Germany | 404/99 |

OTHER PUBLICATIONS

Drawings of Prior Art Devices with Identification Numbers.
Draft Copy of Presentation for Applicant's Invention.

*Primary Examiner*—Stephen J. Novosad
*Assistant Examiner*—Matthew Smith
*Attorney, Agent, or Firm*—Browdy and Neimark

[57] ABSTRACT

A carrier machine for laying sidewalk curbs or paving stones combines pallet transportation forks with a lifting device mounted on an orientable horizontal distribution apparatus, with a prehensive member for grasping the items to be laid and a control to be operated by the laying operator. The control is placed on the prehensive member.

23 Claims, 3 Drawing Sheets

FIG. 1
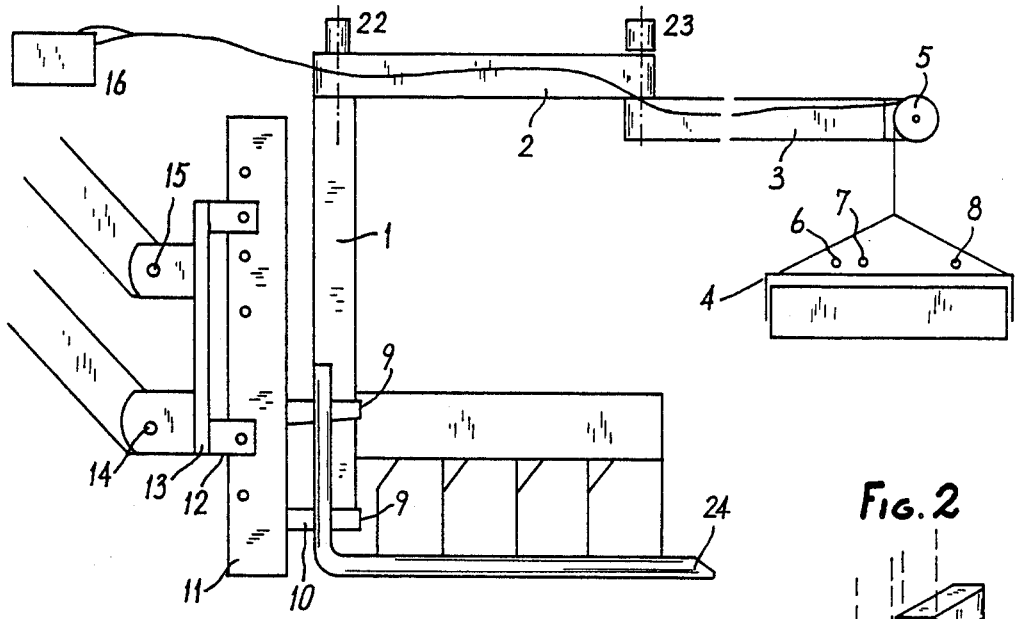
FIG. 2
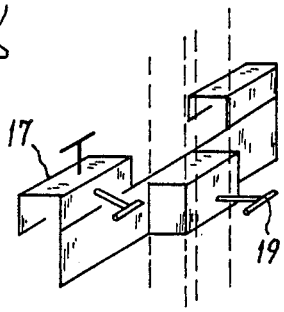
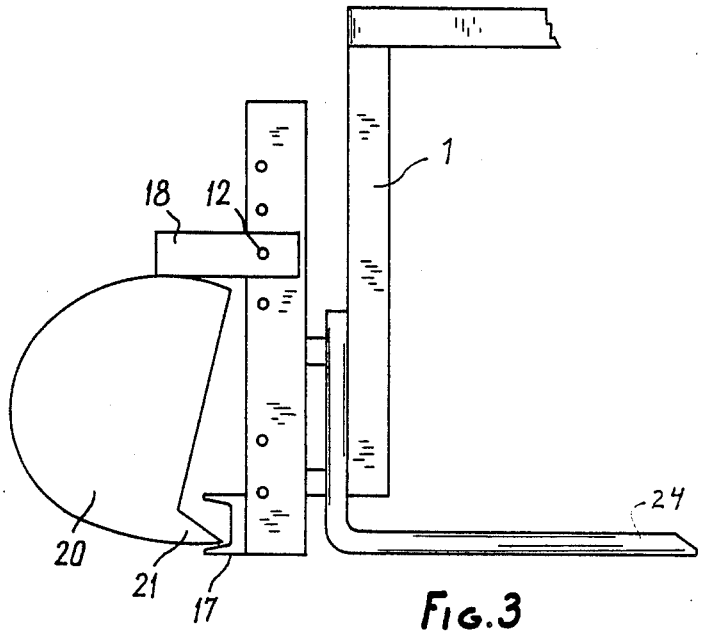
FIG. 3
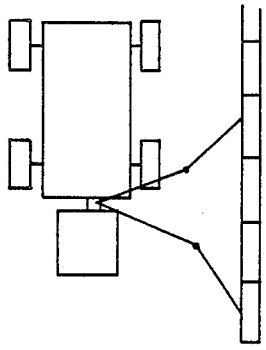
FIG. 4

FIG. 9
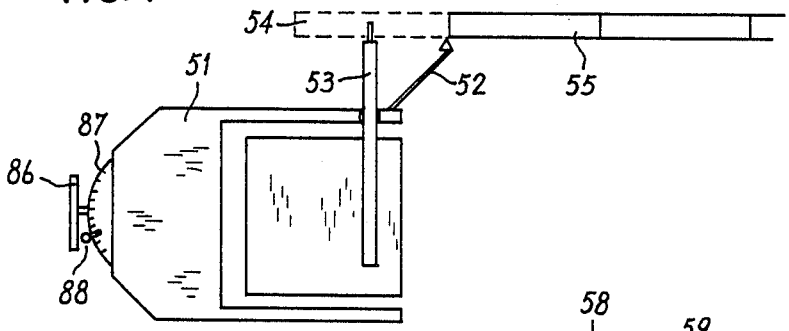
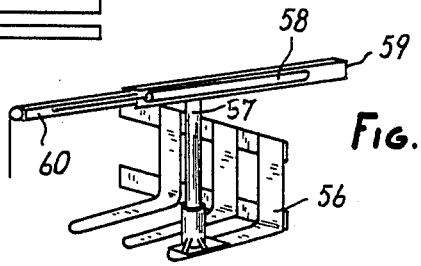
FIG. 10
FIG. 12
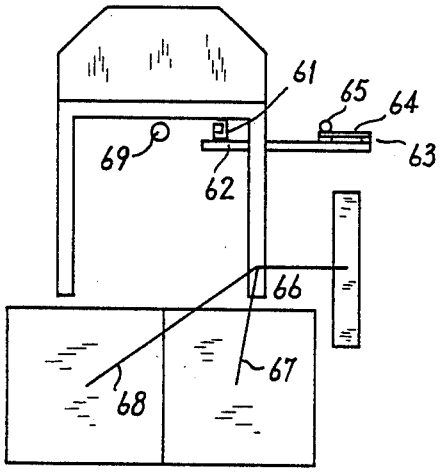
FIG. 11
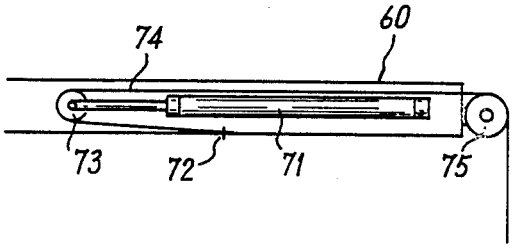
FIG. 13
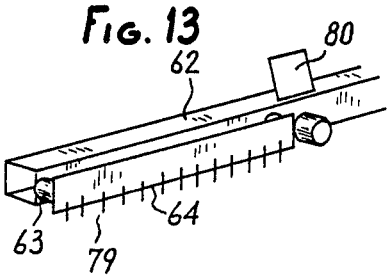
FIG. 14
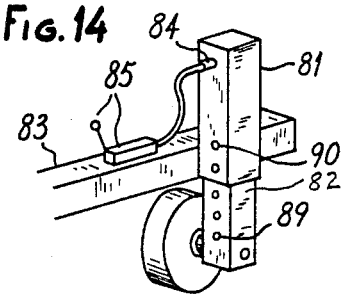

APPARATUS FOR POSITIONING ROAD CURBS, AUTOBLOCKING PAVING BLOCKS AND THE LIKE

BACKGROUND OF THE INVENTION

Laying sidewalk curbs is a time-consuming and tiring operation. Numerous devices directed thereto are already known in the art, such as incorporating hand tools which are used only for a part of the operation. Large machines designed specially for this purpose are too costly to be within the reach of all enterprises.

SUMMARY OF THE INVENTION

The present invention has for its object to reduce, and even totally avoid, the fatigue resulting from this type of work, by providing an apparatus adaptable in a total or partially removable manner on rolling machines, such as for public works, which pick up a pallet, convey it along the line to be laid, and enable taking the curbs one at a time and abutting them in position with required accuracy and rapidity. This object is obtained by associating with various carriers of forks a lifting and distributing device, a prehensive device for gripping the items to be laid, and a control means situated preferably on the prehensive device.

According to the invention, the apparatus for laying sidewalk curbs or paving stones is characterized in that the pallet transportation forks are combined with a lifting device mounted on orientable horizontal distribution apparatus and with a prehensible member provided with control means for the laying operator, the control means being placed on the same carrier machine.

Various other features of the invention will become more apparent from the hereafter detailed description.

BRIEF DESCRIPTION OF THE DRAWINGS

Embodiments of the invention are shown, by way of nonlimiting examples, in the accompanying drawings, wherein:

FIG. 1 is a general view of the apparatus according to the invention.

FIG. 2 shows a type of fixation means for the bracket of FIG. 1;

FIG. 3 shows a particular fixation mode;

FIG. 4 diagrammatically shows distribution possibilities of the articulated arm of FIG. 1;

FIG. 9 shows a variant of the truck of FIG. 7;

FIG. 10 shows a bracket for the truck of FIG. 9;

FIG. 11 shows a sectional view of a tube of the bracket of FIG. 10;

FIG. 12 shows an advantageous position of the distributor arm of FIG. 9;

FIG. 13 shows an example of a levelling operation; and

FIG. 14 shows a wheel of the truck of FIG. 9.

DETAILED DESCRIPTION OF THE INVENTION

Figure 5:
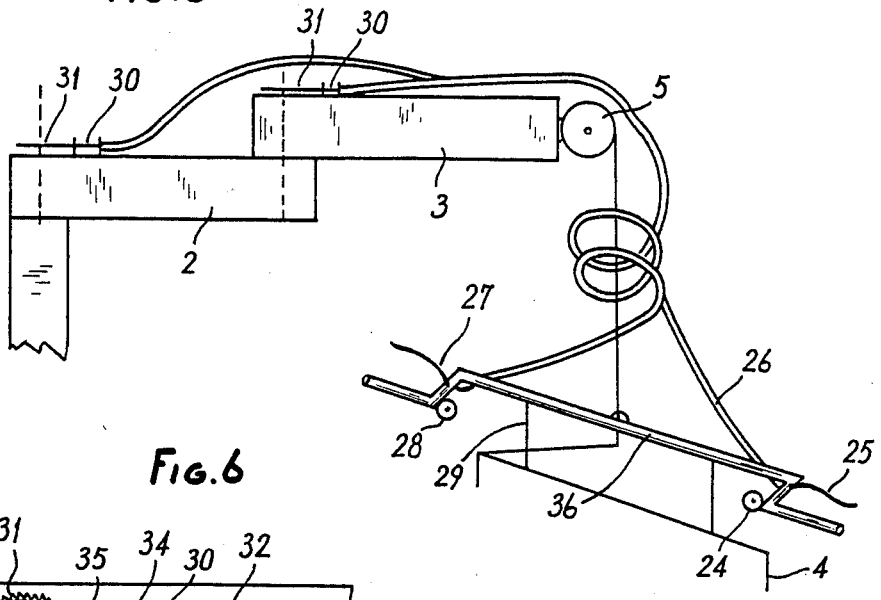
FIG. 5 diagrammatically shows the operation principles.

The prehensive device or gripper 4 can be chosen for various purposes. It is for example possible to provide a mechanical gripper advantageously clamping the curb at its ends. One of the clamping arms can be provided with a thickness corresponding to the thickness of the joint between curbs, which will provide regularity of these joints by abutment during the laying operation of the curbs.

The prehensive device 4 can be an automatic device, for example having an opening and closing control by means of jacks or cylinders, or by using a suction cup system. A vibrator can be fixed on the gripper 4 to vibrate the curb at the moment when it is laid.

Also, the lifting system of the gripper 4 can advantageously be a small electrical winch 5 mounted at the end of the distributor arm 3. The control means 7 is advantageously positioned on the gripper 4, enabling thereby the operator to direct conveniently the gripper 4 with his hands while he controls with his thumb the downstroke switch for laying down the curb or the upstroke switch for picking up the curb. Alternatives to the winch 5 can comprise known hydraulic or electrical means.

The distribution system can be a bracket 1 advantageously fixed to the form 24 of a carrier. The bracket 1 can be a simple vertical mast topped by a pivoting horizontal beam for manipulating the curb. For practical reasons, this beam will preferably have two articulated arms 2, 3, for providing a better sweeping operation. The articulations 22 and 23 of the manipulator beam can alternatively be made free, braked or blocked for providing the required control of the horizontal movements. Control means for the corresponding devices are preferably placed on the gripper 4.

The manipulator beam can be, for the same reasons, actuated in the horizontal plane automatically with aid of jacks, cylinders or motors, such as either hydraulic or electrical motors. The axis of a motor can be the rotation axis.

The corresponding control means can, as previously noted, be preferably placed on the gripper 4.

On machines already having a fork, the bracket 1 can preferably be fixed in a removable manner on the crossbeams of the fork. FIG. 2 shows a typical fixation means.

For machines which are not already provided with forks, it is advantageous to provide on a universal fixation device behind the forks to be used with their horizontal bars, device, for enabling an intermediate fixation means to be placed between the carrier and the universal fixation means.

Although not shown, the mast of the brackets 1 can be a telescopic mast, such a telescopic arrangement being provided only for mechanical adjustments in height, or it can be a part of the lifting system. In fact, it suffices to provide one of the tubes of the bracket 1 with a joint and a plunger-piston which will come to rest in the bottom of another tube, and to provide hydraulic injection means for obtaining a single action jack or cylinder for the upstroke of the telescopic arrangement, while comprising a spring which will control the downstroke thereof.

The carriers of the complete laying device can be of many sorts and are adapted to suit each specific arrangement. Thus, in a simple case, if the enterprise has a lift truck without forks but which can serve as the carrier, it suffices to connect to it the distribution of bracket of FIG. 1 with its control means, and the lifting and prehensive devices. Since as stated above this bracket does not have to be mounted permanently, it can be fixed preferably in a removable manner on the support apron of the forks (see FIG. 2).

If the carrier is a motor-driven machine, it can advantageously provide the electrical or hydraulic power. Where loaders with forks are available, the brackets 1 can be placed, as already mentioned, on the horizontal apron supporting the forks. On the back side of the forks can be fixed two vertical uprights. formed with holes, or hooks, or other universal fixation means, and a mating fixation is provided, as the intermediate fixation means, on the bucket of the loader. The device becomes therefore a complementary equipment of this bucket.

Of course, the equipment could also be provided as a replacement of the bucket itself. If one wishes to have the same work executed by a hydraulic shovel, the bucket of the shovel can be removed and mating fixation points can be provided behind the apron of the fork. It is advantageous to provide an interchangeable intermediate connection piece which has, on the side of the apron, a standard fixation means and, on the shovel side, intermediate fixation means specific to the shovel.

Another case can be envisaged, which is the provision of a small, specific and low priced apparatus, to be drawn by the operator or another machine, or preferably self-propelled.

The explanations hereinafter of FIGS. 7 and 8 will make the operation clear.

The same working system can be used for materials to be laid other than curbs, such as for example self-locking paving stones, whether previously placed on a pallet in the order of their laying or not. A prehensive device formed of an appropriate number of grippers such as the gripper 4 of FIG. 1 will be able to lay down as much as 1 $m^2$ of paving stones previously arranged on the pallet per operation. The operator guiding the prehensive device, by using the control means directly connected thereto, will be able to execute the laying operation with the required accuracy.

Conversely, it is also possible to pick up various articles from the ground and to place the articles on a pallet, provided corresponding grippers are available.

In order to have the operator working under the best possible physical conditions, it is advantageous to provide him with a seat 40 as close as close as possible to the curb of a sidewalk. This seat can be fixed either on the apparatus itself, for example on the horizontal apron, or on the carrier (FIG. 8).

Another device which is particularly safe, simple and mechanically efficient, and which is given as an indication without any limiting character, consists in providing the prehensive gripper with two guiding handles (FIG. 5), each being fitted with a clamping handle of the handle bar of a bicycle or motorcycle hand brake type. The rotation axes of the two articulated arms can then be provided with the equivalent of serrated pinions and a catch, maintained permanently engaged under the action of a spring. The engaging catch can be connected to the clamping handle by a sheathed cable. Instead of a catch and pinion, it is also possible to use known drum or disc braking systems, used in the same conditions.

The assembly can thus be operable only under the action of handles, acting on the cables which in turn unlock the pinions. As soon as the operator releases one or both handles, the assembly will remain blocked in an absolute safe manner, and instantaneously. All the control means can be gathered on a single removable support, enhancing the interchangeability of the grippers.

Another problem that only small loads were tranportable by some prior art loaders. This is advantageously solved by fixing for example two supporting and balancing wheels at the apron ends. These side wheels move upwardly or downwardly according to whether it is a loading or transportation operation. These motions can be produced mechanically, hydraulically or electrically. In such a case, the load is applied directly on these wheels and is not supported on the ground by the machine itself. In this case the load is pushed or drawn on the wheels, and the machine can thus be principally used as a counterweight. At the same time, these wheels will act as stabilizers during the distribution work.

Referring now more particularly to the drawings, FIG. 1 shows a bracket 1 fixed in a removable manner on the fork 24 by fixation device 9. The bracket 1 is topped by arms 2 and 3 articulated at axes 22 and 23. A small winch 5 is electrically connected to a battery 16 for maintaining the gripper 4 which supports control means 6 and 8 for the articulation control and control means 7 for the winch 5. The lifting forks 24 are connected in a known manner to the horizontal crossbeams 10 of the carrier machine, which are in turn connected to two vertical uprights 11 supporting universal fixation means, typically holes as shown, but which could be of any type. These connection means are used for fixing a plate or equivalent intermediate fixation means 13, one side of which supports the above mentioned standard fixation means 12 and the other side of which supports intermediate the fixation means 14 and 15 which are specific to the carrier machine, for instance a hydraulic loader as or a hydraulic shovel.

FIG. 2 shows a type of the fixation device 9 for maintaining the bracket 1, which can thus be positioned in height by means of a clamping device 19 and fixed on the crossbeams of the forks 24 by means of clamping devices 17.

FIG. 3 shows a method of fixation in which a receiving portion 18 is fixed on a bucket 20 of a loader to connect to standard fixation means 12. A crossbeam 17 is used as an abutment for the teeth 21 of the bucket.

FIG. 4 diagrammatically shows distribution possibilities of the articulated arms 2, 3, which can lay-down as much as four curb elements without moving the carrier machine.

FIG. 5 diagrammatically shows particular operation principles. The gripper 4 is fixed in a removable manner at 29 to a type of handlebar 36 supporting on the one hand a control handle 25 which controls the locking system 30 and 31 of the articulation 23 situated on the arm 3 (see FIG. 1) via a sheathed cable 26, and on the other hand a control handle 27 which controls under the same conditions the articulation 22 of the arm 2. The handlebar 36 supports the control means 24 for the winch 5 and the control means 28 controlling for example the forward and rearward motions of the carrier, and which correspond also to the control means 6, 7 and 8 of FIG. 1.

Figure 6:
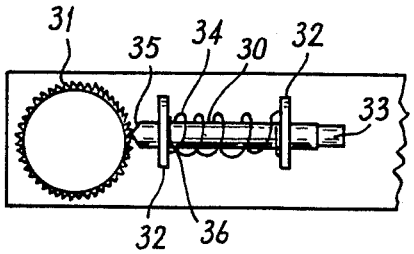
FIG. 6 shows a detail of the blocking system.

FIG. 6 shows a detail of the above locking system. 33 is the traction cable, 32 are perforated guides, 30 is an axis provided with a shoulder 36 and ending in a point 25 which engages with a pinion 31 attached to a rotation axle. A spring 34 keeps the assembly locked at rest in a permanent manner.

Figure 7:
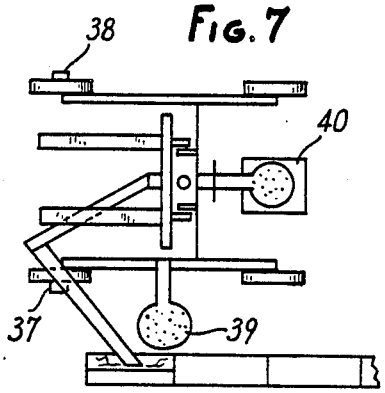
FIG. 7 shows a truck especially designed for the apparatus of the invention.

FIG. 7 shows a type of truck especially designed for this effect, which is capable of readily receiving the fork-bracket assembly. By way of example, two electrical motors can provide the driving of the two front wheels 37 and 38, so that a locking of one or the other wheel provides total maneuverability.

Knowing that the laying operation is carried out laterally, the operator's seat 39 can be placed on the laying side.

All the various functions of the machine can be either hydraulic or electrical, and can receive power from a generator or from batteries.

By arranging the position of the operator's seat 39 and the placement of the control means on the handlebar 36, it is possible to carry out all the work in a seated position.

The seat can even be pivotable in the horizontal plane, either freely pivotable or by being motorized, thereby always providing a good position with respect to the work to be done.

Figure 8:
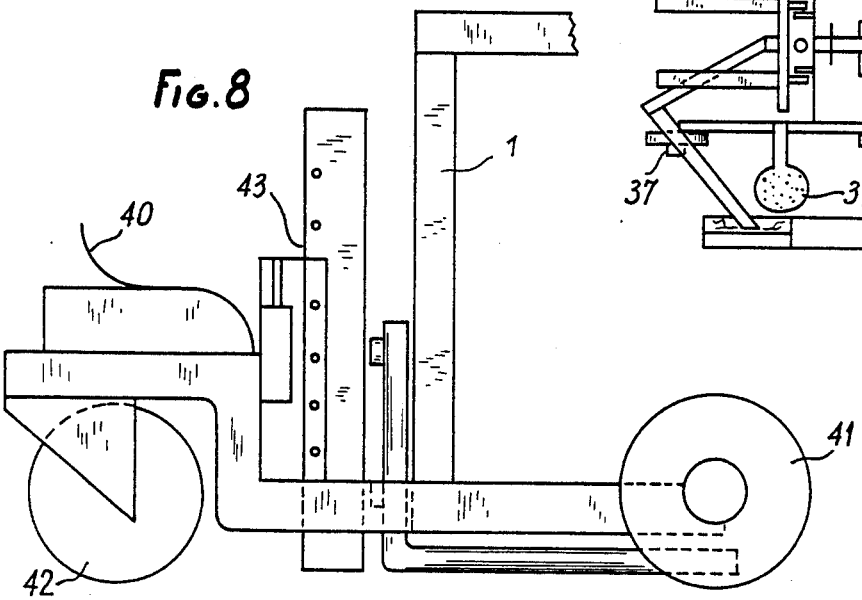
FIG. 8 shows a side view of the truck of FIG. 7.

FIG. 8 is a side view of the machine of FIG. 7, in which 41 is an axial motor, 42 are free wheels and 43 is the lifting system of the fork. By eliminating the motorization, it is of course possible to obtain a machine which can be towed by another machine or manually.

Another advantageous way of practicing the invention is to have the fork and bracket apparatus becoming part of the carrier. For example, rolling means such as two wheels fixedly attached to the assembly can be arranged on one side, while on the opposite side, viz at the end of the fork point, guiding means can be provided for guiding the assembly on the ground, such as small wheels, skids, etc. Such an assembly is capable of being brought unloaded under a pallet, until the fork ends extend under the pallet to be lifted.

For transporting a load, a rolling means can be fixed in a removable manner at the base of the forks, such rolling means being typically wheels or small endless belts. It suffices to provide a lift for the forks in a conventional manner, and the whole assembly will be capable of being displaced, for instance by being towed or by motorizing it to move independently.

Referring again to FIG. 8, the two free wheels 42 can be connected together, as to become self-driving and steering wheels, while the two other wheels 41 can then be independently rotating wheels. According to the type of laying operation which is to be carried out, either frontal or lateral, the bracket 1 can be moved from one position to another, and can be placed also on one of the arms of the carrier truck, preferably adjacent one of the arm wheels 41, which will allow the bracket to work above the opposite wheel 41.

According to the invention, and as particularly shown in the embodiments of FIGS. 9 to 12, the particular position of the distributor bracket on the further E portion of the machine in the direction of the fork provides the shortest beam for laying laterally the curb very close to the machine, and for frontally laying the paving stones. Since the arms, similar to the arms 2, 3 of FIG. 1 are short, it is possible if desired to eliminate the mechanically controlled rotation of FIG. 5 and replace it by a free rotation, possibly provided with a brake.

Such a particular position of the distributor bracket can be provided with a conventional pallet conveyor by using a thrid fork 56 at the end of which the bracket is mounted, as shown in FIG. 10. Such a third fork can also be attached to the crossbeams, parallel to the vertical parts of the two usual forks, and it suffices for control of the machine to connect thereto the hydraulic and power means from the carrier.

An improvement of the laying operation can be obtained by using guiding marks for positioning the machine after each translation motion. By way of example, a mechanical marker 52 can be provided as shown in FIG. 9, to designate the end of a previously-laid curb element, or to warn the operator that he has covered the required distance when moving the carrier. More sophisticated systems, with a photoelectric cell, can even automatically stop the machine at a chosen point, or control simulaneously the extension of the beam by the arms 2, 3 of FIG. 1. The operator's task will also be facilitated if the positioning of the machine brings the bracket exactly into the laying direction. For example, it is possible to use an abutment at 90° from the beam, to align the beam in the direction of the laying operation. It then only remains to control the extension of the beam up to the guiding string and to execute the laying operation via a vertical downstroke.

The operator has still two more problems to deal with. He has to follow a correct straight line and to make curves, while having to correct as little as possible the direction of his machine. As shown in FIG. 9, a simple and inexpensive means to accomplish this is to use a compass 87 and a marker 88 between the steering system 86 and the machine 51. By simply bringing the mark 88 in coincidence with a desired turning angle the required direction is maintained by an appropriate locking of the steering system 86. Thus, the operator has only to advance the machine till he reaches the next position as can be indicated by a marker as above, without having to worry about the direction.

Other more sophisticated means can be envisaged, such as to automatically correct the trajectory.

Till now, the adjustment of laying concrete has been done manually by a worker. This operation can also be made by the machine with a sufficient accuracy.

For example, it suffices to provide an arm 62 fixed onto the lifting system 61 of the fork as shown in FIG. 13. The arm 62 would extend above the mortar, and would be provided for example with an oscillating device 64 such as a vibrating comb-rake and a levelling blade for levelling. The thickness adjustment can be made with reference to the conventional string by using an appropriate device, such as a mechanical or optical device, for example a laser beam device. All the level corrections can be made with a jack or cylinder to lift the pallet. An optical reading system or the like will facilitate the adjustment with reference to the string without touching it.

Due to its construction, the apparatus will generally have a rather high ground clearance. Where the ground is uneven (as is typically the case for laying sidewalk curbs) it can be advantageous or necessary to correct the levels about the longitudinal axis or the transverse axis of the machine. The wheels therefore can be adjustable in height.

As mentioned above, FIG. 9 shows the machine 51 positioned by its guide marks 52 at the end of a curb element 55 already laid down, and shows the beam 53 oriented at 90° in order to placed the curb element 54 to be laid, directly above the laying point. The tiller or steering system 86 is adjusted with respect to directional marks and a locking device of some sort enables maintaining the direction of the machine.

FIG. 10 shows a bracket 57 fixed on the hereinabove mentioned third fork 56. The beam is composed of two tubes 59 and 60 telescopically movable by a jack or cylinder 58. It suffices to connect hydraulically and/or electrically the jack or cylinder 58 to the carrier machine so as to control the beam.

FIG. 11 shows a sectional view of the tube 60 of FIG. 10, in which is accommodated a vertical lifting system similar to that of FIG. 1, formed by a hydraulic (or electrical) jack or cylinder 71 comprising a return pulley 73 for a cable 74 fixed at 72 onto the tube 60. The cable 74 exits by a pulley 75 which is used similarly to the electircal winch 5 of FIGS. 1 and 5.

FIG. 12 shows advantageous positions of the distributor beam, namely the position 66 for positioning curb elements to be laid laterally, and positions 67 and 68 for positioning paving stones laid frontally. As mentioned above, the arm 62 is secured to the lifting portion 61 controlled by a jack or cylinder 69. The arm 62 supports at its free end the oscillating device 64 for levelling the the concrete. The oscillating device 64 is is placed on silent blocks 63 for preventing the vibrations of the oscillating device 64 from being transmitted to the machine itself. The oscillating device 64 is driven by a vibrator 65 or any other means.

FIG. 13 shows an example of a levelling means, including the arm 62, the silent blocks 63, the oscillating device 64 in the form of a rake provided with a set of tines 79, and a visual guiding system on the string in the form of a mirror 80.

FIG. 14 shows a wheel which can be mechanically adjusted in height by a pin extending through holes 89 and 90 in telescopic tubes 81, 82, the tube 81 being secured on the chassis 83 of the carrier. With a hydraulic jack or cylinder placed beween the two tubes 81, 82, controlled at 84 and driven at 85, the height can be adjusted instantaneously.

The transportation from one working site to another can be easily carried out by providing the machine with two transportation wheels, retractable or removable during work, and with a tiller which can be removable. Once the machine is raised on at least two wheels and the tiller is secured, it then becomes purely and simply a trailer as any other trailer.

We claim:

1. A movable device with plural moving parts for laying preformed items, comprising:

a pair of forks on the device for receiving a pallet of said items, lifting means for lifting one or more of said items at a time from said pallet, an orientable horizontal distribution means operatively connected to said forks and to which said lifting means is connected, a prehensive member, connected to said lifting means, for grasping said one or more items at a time for said lifting thereof from said pallet and for said laying thereof, and control means located on a predetermined part of said prehensive member for controlling said lifting means, said distribution means, and said prehensive member for allowing an operator to control the lifting and laying of said one or more items at a time.

2. The device of claim 1, wherein fixation means are provided for interchangeably connecting the device between several types of carrier machines.

3. The device of claim 1, comprising a connection element having on one side a stardard fixation for supporting said forks connected with said distributing means and on the other side a specific fixation for connecting the device to a respective carrier machine.

4. The device of claim 1, wherein said horizontal distribution means are intermittently lockable and unlockable by said control means.

5. The device of claim 1, wherein said control means are removably connected to said prehensive member for interchangeability of the prehensive member to be used.

6. The device of claim 1, wherein said lifting means is an electric winch.

7. The device of claim 1, wherein said prehensive member is a gripper with two arms, and one of the arms of the gripper corresponds in thickness to the width of a joint between abutting ones of said items being successively laid.

8. The device of claim 1, connected with a carrier of a type of autonomous truck having a shape extending on two sides of the pallet and supported by at least three wheels, said control means allowing said operator to advance said carrier with said device mounted carried thereon for continuing the laying of said preformed items.

9. The device of claim 1, comprising two complementary wheels adapted for being lifted or brought down, said two complementary wheels being secured to the device, thereby reducing weight on the carrier, the load being placed on said two complementary wheels during a displacement for said laying of said items by said horizontal distribution means.

10. The device of claim 1, said lifting means including a vertical bracket, said bracket being secured to said forks.

11. The device of claim 1, comprising a third fork connected adjacent said pair of forks, said lifting means including a vertical bracket mounted on said third fork.

12. The device of claim 1, comprising a guiding mark means for positioning the device for successive layings of said items.

13. The device of claim 1, comprising a concrete leveling adjustment means connected therewith.

14. The device of claim 1, characterized in that wheels are provided with adjusting means in height for leveling the device.

15. The device of claim 1, characterized in that a steering system is provided with guiding marks and locking means.

16. The device of claim 1, characterized in that the lifting means is a hydraulic jack operating a cable reeved on a pulley.

17. The device of claim 1, comprising transport wheels that allow transforming the device at will into a trailer.

18. The device of claim 17, wherein said transport wheels are removable.

19. The device of claim 17, wherein said transport wheels are liftable upward for the laying of said items at each job.

20. The device of claim 1, wherein pair of said forks are an integral part of a carrier means for controlling displacement of the device into position for said laying of said preformed items, and said orientable horizontal distribution means is supported by fixation means interchangeably carried by a plurality of different types of said carrier means, each said different type of carrier means respectively supplying pair of said forks for supporting said pallets of preformed items for the laying thereof.

21. The device of claim 1, connected by fixation means to carrier means for displacing the device of successive laying of said preformed items, said fixation means including on a first side means for being connected interchangeably to different types of said carrier means, and on a further side providing said forks for supporting said pallets.

22. The device of claim 1, wherein said device comprises moving means for motion for allowing successively performing said laying of said preformed items from said pallet.

23. The device of claim 2, wherein said control means includes means for controlling motion of said carrier machine with the device connected thereto, including in forward and backward directions, for successively performing said laying of said preformed items from said pallet.

* * * * *